US006688148B1

(12) United States Patent
Hartzell et al.

(10) Patent No.: US 6,688,148 B1
(45) Date of Patent: Feb. 10, 2004

(54) MANUFACTURING PROCESS FOR MAKING ENGINE COMPONENTS OF HIGH CARBON CONTENT STEEL USING COLD FORMING TECHNIQUES

(75) Inventors: Raymond C. Hartzell, Defiance, OH (US); Jeffrey A. Buck, Canton, MI (US); Stanley Marchewka, Defiance, OH (US)

(73) Assignee: Defiance Precision Products, Inc., Parsippany, NJ (US)

( * ) Notice: Subject to any disclaimer, the term of this patent is extended or adjusted under 35 U.S.C. 154(b) by 0 days.

(21) Appl. No.: 10/056,628

(22) Filed: Jan. 25, 2002

Related U.S. Application Data

(60) Provisional application No. 60/264,521, filed on Jan. 26, 2001.

(51) Int. Cl.[7] ..... B21B 45/02; B21C 9/02

(52) U.S. Cl. ..... 72/42; 72/286; 148/599; 148/651

(58) Field of Search ..... 72/286, 41, 42; 148/599, 651

(56) References Cited

U.S. PATENT DOCUMENTS

| | | | | | |
|---|---|---|---|---|---|
| 2,870,903 | A | * | 1/1959 | Leduc | 72/42 |
| 3,756,865 | A | * | 9/1973 | Sastri | 148/608 |
| 4,106,957 | A | * | 8/1978 | Tournoy | 148/529 |
| 4,203,782 | A | * | 5/1980 | Yamada et al. | 148/578 |
| 4,358,325 | A | | 11/1982 | Stevenson | 148/125 |
| 4,393,563 | A | | 7/1983 | Smith | 29/149.5 DP |
| 4,945,749 | A | | 8/1990 | Walker et al. | 72/356 |
| 5,211,772 | A | | 5/1993 | Ashida et al. | |
| 5,330,594 | A | | 7/1994 | Gallagher, Jr. | 148/651 |
| 5,453,139 | A | | 9/1995 | Gallagher, Jr. | 148/651 |
| 5,928,442 | A | * | 7/1999 | Machmeier et al. | 148/335 |
| 5,944,920 | A | * | 8/1999 | Fukushima | 148/325 |

* cited by examiner

*Primary Examiner*—Daniel C. Crane
(74) *Attorney, Agent, or Firm*—Rader, Fishman & Grauer PLLC

(57) ABSTRACT

A method of making high carbon content steel engine components is disclosed. The method includes pre-processing a supply wire of high strength steel having a spheroidized carbide microstructure and high-strength mechanical properties, applying a lubricant on the surface of the supply wire, and cold-forming the blank to substantially reduce or eliminate the need for any additional surface grinding operations.

18 Claims, 4 Drawing Sheets

MANUFACTURING PROCESS FOR MAKING ENGINE COMPONENTS OF HIGH CARBON CONTENT STEEL USING COLD FORMING TECHNIQUES

RELATED APPLICATIONS

The present invention claims priority from provisional patent application Ser. No. 60/264,521 filed on Jan. 26, 2001, the entire contents of which are incorporated by reference in its entirety.

FIELD OF THE INVENTION

The present invention relates to a method of making high carbon content steel engine components, and more particularly, it relates to a process of making high carbon content steel engine components using cold-forming techniques.

BACKGROUND OF THE INVENTION

There are several known blanking processing techniques available for manufacturing engine components from steel. Specific examples of such techniques include screw machining, warm forming, and hot forging. Screw machining involves taking bar stock and machining the stock, using a multi-spindle machine, into a raw shape, or starting blank. The starting blank is then subjected to further machining to tolerance. While effective for generating a starting blank, material waste tends to be high for this operation.

Warm forming involves heating a supply wire below a critical temperature to improve malleability. For high carbon content steel (steel having a carbon content between 0.93–1.05%) such as SAE 52100 material specified in ASTM A295, the critical temperature is 1330° F. Once heated, the material is formed into a desired shape. However, the warm forming technique is disadvantageous because the shaped parts cannot meet the tight tolerances required for many applications. More specifically, as the shaped part cools, it deforms, thereby requiring additional machining steps to achieve the desired shape.

Hot forging starts with either bar stock, supply wire or a slug. The starting material is heated in a manner similar to warm forming, but to a higher temperature. More specifically, the material is heated above the critical temperature but below its melting point. Once heated, the material is hammered into the desired shape. However, similar to warm forming, as the shaped part cools, the part deforms. Moreover, the tooling used to perform the hammering operation tends to be crude and imprecise such that additional machining is required to achieve the desired shape.

After the shaped part is formed, the part is then heat treated. After heat treating, the shaped part is then subjected to multiple grinding operations; end grind, outside diameter grind, inside diameter grind and outside diameter finishing operations. Once the part is complete it is fitted with mating components and assembled into final assembly.

In addition to machining, warm forming and hot forging, it is known to employ cold forming techniques for produce complex parts to tight tolerances, or "near net shape". For example, it has been known to employ cold-forming techniques, such as upsetting, heading, and extrusion for the manufacture of high strength nuts and bolts. However, such cold forming techniques have only been proven effective for forming complex parts using low carbon content material to avoid tool damage and cracking of the part during manufacturing.

However, complex parts that experience high contact stress, such as cam follower rollers, must be produced from high carbon content steel (e.g. 52100 grade). Previous attempts to cold form high carbon content steel have resulted in several problems. One problem experienced was that the near net shape components tended to crack due to work hardening of the supply material. Another problem experienced was increased wear on the forming tools, and in many instances failure of the tools.

To alleviate the difficulty in cold forming high carbon content steel, specific processing steps have been employed to process the high carbon content steel prior to cold forming. Traditionally, processing of high carbon content steel wire has included multiple drawing operations to yield the desired physical properties. Because material volume is critical during the forming process to assure adequate die fill, steel supply wire processing has included a two step drawing process, with the first draw resulting in a major cross sectional area reduction of 25% or greater. The second drawing operation is a more precisely controlled sizing draw with a 5% or less area reduction.

An example for standard processing for supply wire is as follows. First, a standard wire rod with a starting diameter of 18 mm is provided. The starting wire is then annealed. A zinc-phosphate coating is then applied to act as a lubricant and the wire is drawn to 15.5 mm (25.8% reduction). The drawn wire is annealed again. A peeling operation is then performed, peeling the diameter down to 14.7 mm. The wire is then wire brushed and drawn to 14.5 mm (a 2.7% reduction). The wire then undergoes an eddy current check to check for defects and a zinc-phosphate coating is applied over the wire to act as a lubricant through further processing.

While somewhat effective, as the number of operations required to process the wire increase, so do costs. Thus, there exists a need for a cost effective method of manufacturing engine components of high carbon content steel (i.e., having a carbon content greater than approximately 0.65%) the includes a method of processing high carbon content steel that is adequately formable to substantially limit damage to forming tools. Moreover, there exists a need for a cost effective method of manufacturing engine components of high carbon content steel that permits displacement of material from a center of the blank, to conserve material and reduce costs.

SUMMARY OF THE INVENTION

The present invention relates to a cold forming manufacturing process to produce precision, hardened and ground engine components from high carbon steel (carbon content greater than 0.70%). To avoid the deficiencies in the prior art, namely limited tooling life and cracks in the final finished part, the first step in the process includes providing a preprocessed high carbon content steel starting material that has increased formability and reduced internal material stress.

In accordance with the present invention, a high carbon content steel supply wire having a carbon content greater than at least 0.70%, and even more preferably, greater than 0.90%, is specifically processed. The first step of processing the supply wire includes annealing to increase its formability, and then coating the supply wire with a lubricant, such as zinc phosphate. Next, the annealed supply wire is drawn to a first predetermined diameter, such that the supply wire undergoes at least a 25% reduction. After the drawing operation, the drawn supply wire is peeled to a second predetermined diameter to remove surface defects.

The supply wire is then wire brushed.

The brushed supply wire is next subjected to a second drawing operation. The second drawing operation is more controlled and reduces the diameter by less than 5%. After drawing, the supply wire is eddy current checked for defects. According to one aspect of the invention,.the drawn supply wire is annealed again to provide increased formability during cold forming. Finally, the annealed supply wire is coated with a lubricant, such as zinc phosphate or an organic material.

Once preprocessed, the supply wire is next cold formed into a "near net shape" meaning that the part is produced substantially close to final dimensions. The cold forming operation is performed through either heading or extrusion. Due to the use of cold forming, the supply material is forced out into the near net shape, thus minimizing waste and reducing or eliminating grinding operations. In accordance with the present invention, the cold forming operation is performed in multiple operations and in progressive steps to avoid work hardening, thereby avoiding cracking and damaging to both the part being formed and the forming tools. Moreover, because the part is formed to near net shape, no additional machining is required, only minimal grinding to hold certain features of the part to very tight tolerances and to improve surface finish.

BRIEF DESCRIPTION OF THE DRAWING

The features and inventive aspects of the present invention will become more apparent upon reading the following detailed description, claims, and drawings, of which the following is a brief description:

DETAILED DESCRIPTION OF PREFERRED EMBODIMENTS

The method of the present invention is useful for producing a wide variety of finished high carbon content steel parts, including, but not limited to, cam follower rollers for automotive applications. In a preferred embodiment for manufacturing a cam roller, the method of the present invention includes providing preprocessed wire of a predetermined high-strength and high carbon content steel material, having a microstructure of large, spheroidized carbide structures. The steel wire preferably has the following properties, an ultimate yield strength expressed as Z% (% area reduction at yield) greater than approximately 63%, an ultimate tensile strength expressed as Rm greater than approximately 610 Mpa and a hardness reading of less than approximately 200 Brinell to provide an engine component that is free from cracks.

To begin, a supply wire is preferably provided that has been specially processed so as to have a controlled, predetermined surface finish and surface finish direction. The surface finish is critical because small discontinuities in the surface finish act as stress risers and may propagate into cracks. Accordingly, the smoother the surface, the less stress risers and therefore, a lower potential to crack. The surface finish direction is also important because high stresses in the part are typically in one direction. Thus, if the surface finish is not in that same direction, the part will again have a lower propensity to crack while being formed.

Figure 1:
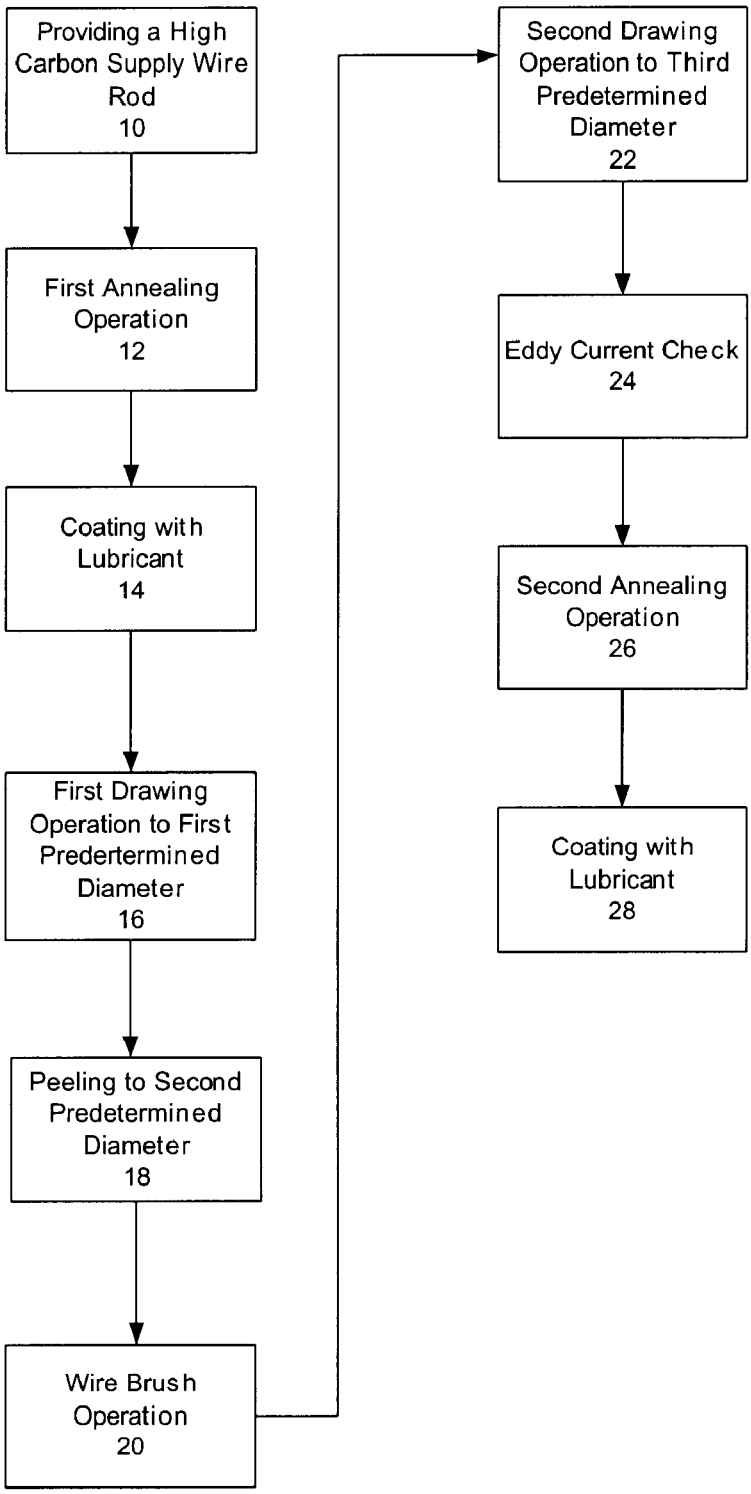
FIG. 1 is a flow chart illustrating a method of processing high carbon content steel wire for cold forming operations.

Referring to the flowchart of FIG. 1, in accordance with one aspect of the present invention, to achieve the predetermined surface finish and surface finish direction, a supply wire rod 10 of high carbon content steel is processed accordingly. Supply wire rod 10 of high carbon steel (SAE 52100 or equivalent), with a carbon content of at least approximately 0.65% is provided. Preferably, the carbon content is greater than 0.90% such that a finished part may withstand high contact stresses.

Next, supply wire 10 is annealed 12 to soften supply wire 10 for increased formability. Supply wire 10 is then coated 14 with zinc phosphate or other suitable lubricant to lubricate supply wire 10. Lubricated supply wire 10 is next drawn 16 to a predetermined diameter so as to undergo at least an approximately 25% reduction. Unlike the prior art, drawn and reduced supply wire 10 is next peeled 18 to a second predetermined diameter and then the exterior surface is wire brushed 20 to adhere the lubricating coating to supply wire 10. Supply wire 10 is then drawn 22 again to a third predetermined diameter. Drawing 22 is a more precise draw than initial draw 16 and involves a diameter reduction that is significantly less than the reduction in draw 16. In the preferred embodiment, draw 22 involves less than an approximately 5% reduction. Supply wire 10 may then subjected to an eddy current check 24.

In accordance with the present invention, after an optional eddy current check 24, supply wire 10 is then subjected to a second annealing operation 26. Unlike the prior art, second annealing operation 26 occurs after the peeling operation 18, and just prior to cold forming supply wire 10 into a near net shape (to be discussed in greater detailed below). Unexpectedly, it was determined that eliminating an annealing operation prior to peeling, as was done in the prior art, did not compromise peeling operation 18. Further, by eliminating an annealing step prior to peeling operation 18, processing steps for supply wire 10 did not increase, and nor did costs. Moreover, it was determined that incorporating second annealing operation 26 after second drawing 22 operation improved the formability of supply wire 10 for subsequent processing, reducing cracking problems and increasing tool life. After annealing operation 26, supply wire 10 is coated 28 with either zinc phosphate or dipped in soap to lubricate supply wire 10 prior to undergoing a part forming process.

In one preferred embodiment, to alleviate the problems associated with the use of low melting point materials, in accordance with the present invention, zinc-phosphate-free wire lubricant coatings are employed as lubricant coatings. Suitable coatings include drawing soaps, calcium phosphate, molibdium sulfide, Teflon or other organic coatings.

When using an organic lubricant, such as soap, in place of a zinc phosphate the progressive die design and overall forming process must be one such that steel movement against the outside diameter forming surface is minimized. This is undertaken such that the part sensitive die tooling life is not compromised when switching from a zinc phosphate lubricant to soap. This approach is also done to prevent the risk of cold welding between the die and the blank that may occur if the soap lubricant is missing from a significant length of supply wire.

An example of a preprocessing supply wire 10 in accordance with the present invention is as follows. A supply wire rod 10 having greater than 0.70% carbon content and having an 18 mm diameter is provided. Supply wire 10 is annealed and then coated with zinc phosphate or other suitable lubricant. Supply wire 10 is then drawn to a 15.5 mm diameter (25.8% reduction) and peeled to a 14.7 mm diameter. Next, supply wire is wire brushed and drawn to a 14.5 mm (2.7% reduction) diameter. An eddy current check is employed and supply wire 10 is then annealed for increased formability and coated with lubricant, such as zinc phosphate, or subjected to soap dipping, prior to forming operations.

Figure 2:
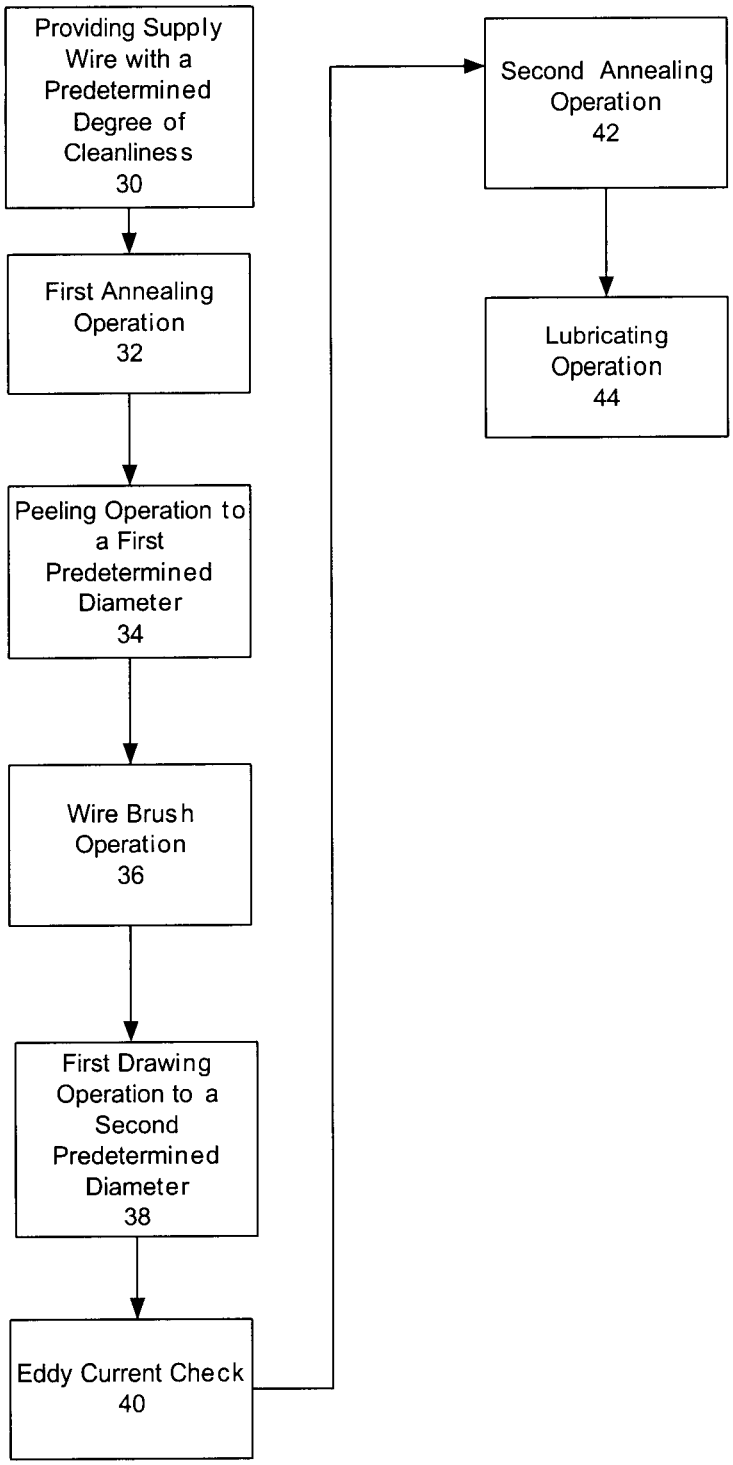
FIG. 2 is a flow chart illustrating an alternative method of processing high carbon content steel wire for cold forming operations.

An alternative method for preprocessing high carbon content steel supply wire for use in cold forming operations is also disclosed. Referring to FIG. 2, a supply wire 30 is provided that has a predetermined degree of cleanliness. Supply wire 30 is annealed 32 and peeled 34 to a first predetermined diameter. Next, supply wire 30 is wire brushed 36 and drawn 38 to a second predetermined diameter. Drawn supply wire 30 is then subjected to an eddy current check 40 and then subjected to a second annealing operation 42 for increased formability, in accordance with the present invention. Finally, supply wire 30 is then lubricated 44 with zinc phosphate or subjected to soap dipping.

An example of a preprocessing supply wire 30 in accordance with the present invention is as follows. A supply wire rod 30 having greater than 0.70% carbon content and having a 16 mm diameter is provided. Supply wire 30 is annealed 32 and then peeled 34 to a 15.2 mm diameter. After peeling operation 34, supply wire 30 is wire brushed 36 and drawn to a 14.5 mm diameter (9% reduction). Finally, supply wire 10 is eddy current checked 40, annealed 42 a second time, and lubricated 44 with zinc phosphate or other suitable lubricant.

In accordance with the present invention, once a preprocessed supply wire 10 or 30 is provided, it is cold formed. Cold forming reduces material waste as compared to traditional machining processing, such as screw forming. In the preferred embodiment, preprocessed wire 10 or 30 is cold formed using extrusion, heading, or other suitable cold forming process.

Extrusion involves forcing the wire blank 10 or 30 through a die orifice of a predetermined cross-section to produce a length of substantially uniform cross section. A pin is positioned within the die orifice. As supply wire 10 or 30 is forced through the die, and due to the increased formability supply wire 10 or 30 caused by the preprocessing step, supply wire 10 or 30 flows over and around the pin or pins. Thus, the resulting blank is formed into a predetermined contour with minimal waste material.

In a heading operation, a die is provided and supply wire 10 or 30 is positioned in the die with one end in contact with a pin or plurality of pins. The pin is hammered into the supply wire 10 or 30 in the die, such that supply wire 10 or 30 flows around the pin in the die. In accordance with the present invention, engine components formed using cold forming are performed in a multi-stage process 50, as may be seen in FIG. 3. The multi-stage process 50 may use one or more different cold forming techniques.

The cold formed blank produced via the preprocessed supply wire shall result in a crack free surface, crack free sub-layer surface. The aforementioned properties are required in the cold formed blanks to prevent spalling, cracking or any other defect that may occur on a finished engine roller when used in the application or when subjected to a 1000-hour or longer engine cycle test as specified by the engine's original equipment manufacturer.

After the cold-forming operation, the processed blank is then pre-washed, heat treated and quenched at predetermined temperatures and for predetermined time periods based on the nominal chemistry for the grade of steel being employed. The heat treat and quenching operations alleviate all induced stresses caused by the cold forming operation so as to retain a high degree of wear and fatigue resistance.

In accordance with one aspect of the invention, because the method of the present invention permits forming a near net shape for the part without over stressing the forming tooling or pushing the supply material beyond its yield strength, cracking problems are minimized. Accordingly, grinding operations, such as the end grind, outside diameter grind, and inside diameter grind may be substantially reduced and/or eliminated due to the dimensional control of the cold forming process. Thus, the method of the present invention reduces manufacturing time and expense, and increases the strength of the blank or tool life.

Figure 3:
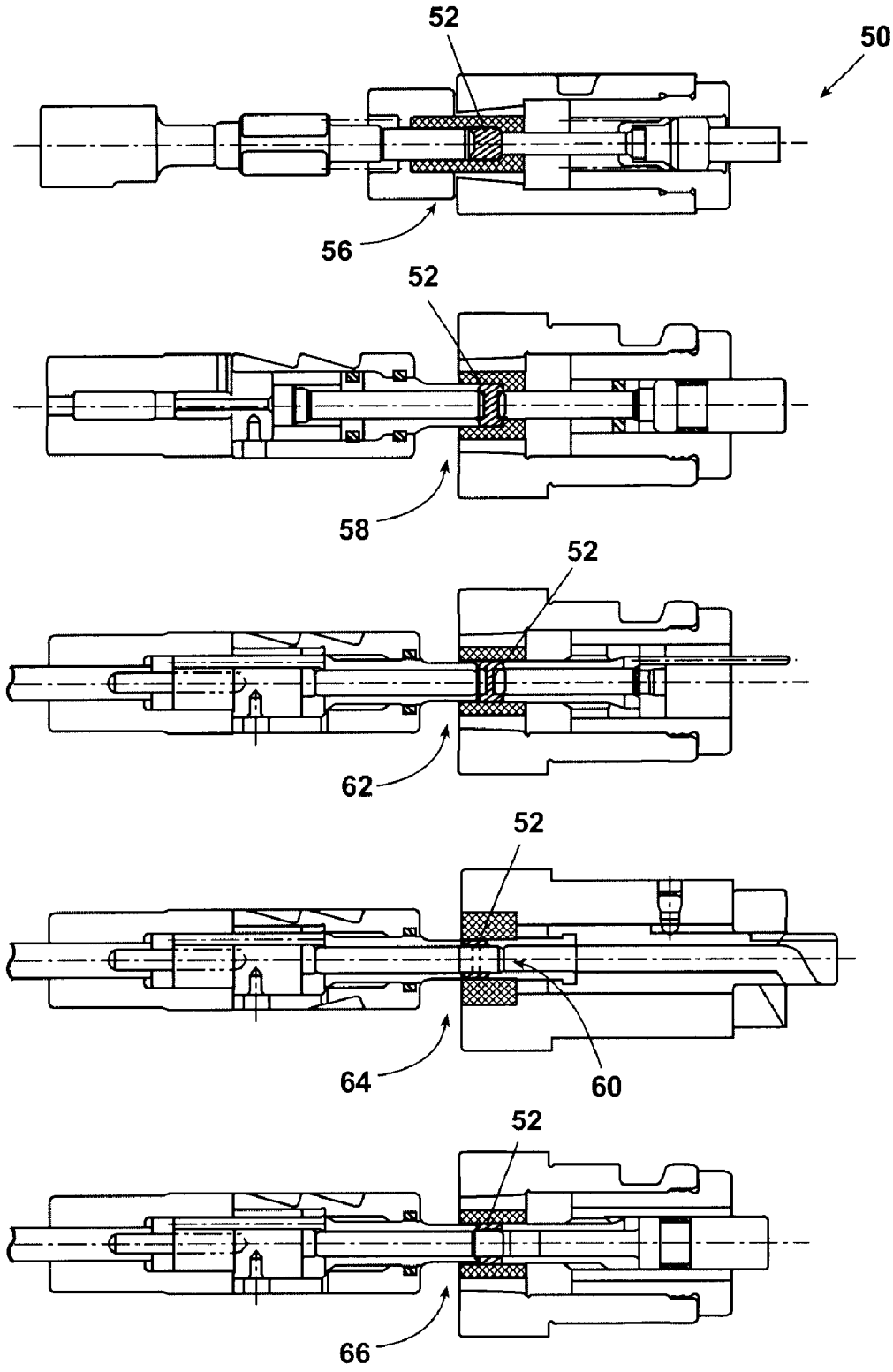
FIG. 3 illustrates the processing operations for manufacturing a cam follower roller in accordance with the present invention.
Figure 4:
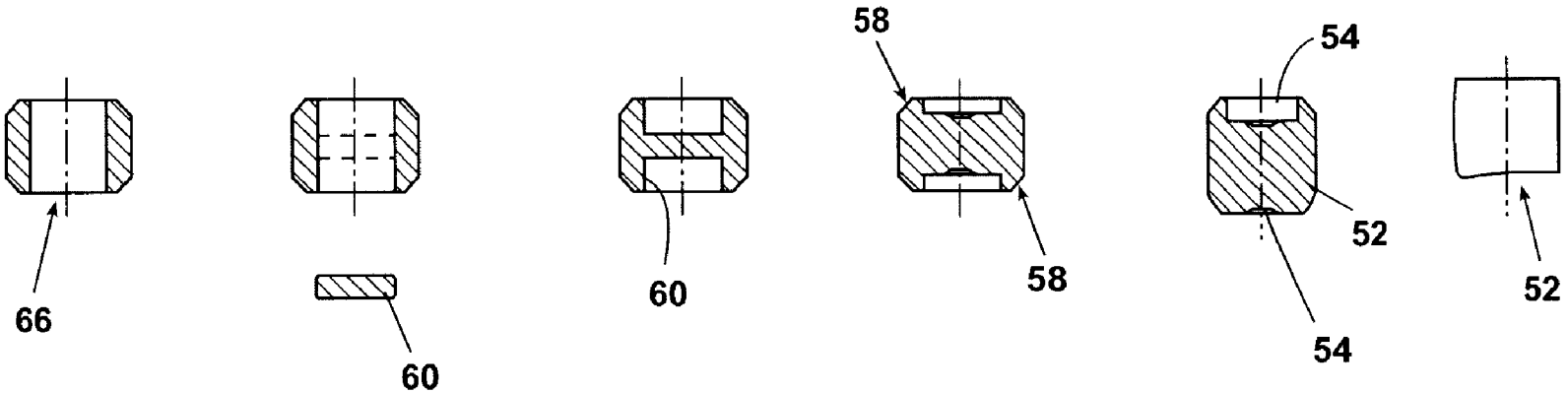
FIG. 4 illustrates a cam follower roller at various stages of the processing operations in accordance with the present invention.

While it is understood that many different engine components may be formed using the above described process, FIGS. 3–5 illustrate a cam follower roller that is manufactured in accordance with the present invention. Supply wire 10 or 30 is provided in accordance with the present invention. It is then cold formed 50 in the five step process. First, a slug 52 is cut from supply wire 10 or 30. Next, ends 54 of slug 52 are dimpled 56. The outside diameter of corners 58 of slug 52 are then rounded 59. The inside diameter 60 is thinned out 62. Finally, the thinned out inside diameter 60 is punched out 64 resulting in a completed cam follower roller 66 that has a near net shape. Because cam follower roller 66 is formed in a progressive manner to avoid work hardening, damage and cracking to both cam follower roller 66 and tooling is avoided. Moreover, because cam follower roller 66 is formed to a near net shape, grinding operations, such as the end grind, outside diameter grind and inside diameter grind may be substantially reduced and/or eliminated.

After the cold forming operation, cam follower roller 66 is pre-washed, heat treated and quenched in accordance to industry standards, based upon the nominal chemistry for the grade of high carbon content steel used in forming cam follower roller 66.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A method of making a high carbon content steel engine component, comprising the steps of:

pre-processing high carbon content steel supply wire having greater than approximately 0.70% by weight of carbon, said steel supply wire being processed according to the following method:

providing a supply wire rod having a carbon content greater than approximately 0.70%;

annealing said supply wire rod;

coating said supply wire rod with a first lubricating coating;

subjecting said lubricated supply wire rod to a first drawing operation, wherein said supply wire rod is drawn to a first predetermined diameter;

reducing said wire rod to a second predetermined diameter;

subjecting said supply wire rod to a second drawing operation, wherein said supply wire rod is drawn to a third predetermined diameter;

annealing said drawn supply wire rod to increase the formability of said drawn supply wire; and coating said annealed and drawn supply wire rod with a second lubricating coating;

cold forming processed supply wire to a near net shape component, heat treating said component for a predetermined time and at a predetermined temperature dependent upon the base chemical properties of said supply wire; and quenching for a predetermined time and at a predetermined temperature dependent upon the base chemical composition of said wire.

2. The method of claim 1, wherein said reducing step is achieved by pealing said drawn supply wire to said second predetermined diameter.

3. The method of claim 2, further including the step of wire brushing said drawn supply wire rod prior to said step of subjecting said supply wire rod to a second drawing operation.

4. The method of claim 1, wherein said first lubricating coating is zinc phosphate.

5. The method of claim 1, wherein said first drawing operation reduces the diameter of said supply wire rod by at least approximately 25%.

6. The method of claim 1, wherein said second drawing operation reduces the diameter of said supply wire rod by less than approximately 5%.

7. The method of claim 1, wherein said second lubricating coating is zinc phosphate.

8. The method of claim 1, wherein said second lubricating coating is zinc phosphate free.

9. The method of claim 8, wherein said zinc-phosphate-free lubricant is an organic coating.

10. The method of claim 9, wherein said zinc-phosphate-free lubricant is one of a drawing soap calcium phosphate, molibdium sulfide, and Teflon.

11. The method of claim 1, wherein said supply steel wire has a carbon content greater than approximately 0.90% by weight.

12. The method of claim 1, wherein said cold forming operation is accomplished by one of heading and extrusion.

13. The method of claim 12, wherein said cold forming operation is performed in multiple stages in a progressive manner to minimize work hardening and cracking damage to the component being formed.

14. A method of preprocessing high carbon content steel supply wire for use in cold forming operations, comprising:

providing a supply wire rod having a carbon content greater than approximately 0.90%;

annealing said supply wire rod;

coating said supply wire rod with a zinc phosphate lubricating coating;

subjecting said lubricated supply wire rod to a first drawing operation, wherein said supply wire rod is drawn to a first predetermined diameter;

peeling said drawn supply wire rod to a second predetermnined diameter;

wire brushing said drawn supply wire rod;

subjecting said supply wire rod to a second drawing operation, wherein said supply wire rod is drawn to a third predetermined diameter;

annealing said drawn supply wire rod to increase the formability of said drawn supply wire rod; and coating said annealed and drawn supply wire rod with a second lubricating coating.

15. The method of claim 14, wherein said second lubricating coating is zinc phosphate.

16. The method of claim 15, wherein said second lubricating coating is one of a drawing soap, calcium phosphate, molibdium sulfide, and Teflon.

17. The method of claim 15, further including checking said supply wire for deficiencies or imperfections after said second drawing operation.

18. The method of claim 17, wherein said supply wire is checked by performing and eddy current check.

* * * * *